158-306 3R
12/22/87 XR 4,714,114

United States Patent [19]
Jones

[11] Patent Number: 4,714,114
[45] Date of Patent: Dec. 22, 1987

[54] USE OF A PROPPANT WITH CONTROLLED PULSE FRACTURING

[75] Inventor: Lloyd G. Jones, Dallas, Tex.

[73] Assignee: Mobil Oil Corporation, New York, N.Y.

[21] Appl. No.: 944,739

[22] Filed: Dec. 22, 1986

[51] Int. Cl.[4] ..... E21B 43/267
[52] U.S. Cl. ..... 166/280; 166/299; 166/300
[58] Field of Search ..... 166/308, 258, 259, 280, 166/299

[56] References Cited

U.S. PATENT DOCUMENTS

| | | | |
|---|---|---|---|
| 2,988,143 | 6/1961 | Scotty | 166/299 |
| 3,642,068 | 2/1972 | Fitch et al. | 166/307 |
| 3,713,387 | 1/1973 | Lozanski | 166/299 X |
| 3,822,916 | 7/1974 | Jacoby | 166/299 X |
| 3,863,709 | 2/1975 | Fitch | 166/271 X |
| 3,896,879 | 7/1975 | Sareen et al. | 166/300 X |
| 4,015,663 | 4/1977 | Strubhar | 166/258 |
| 4,019,577 | 4/1977 | Fitch et al. | 166/259 |
| 4,039,030 | 8/1977 | Godfrey et al. | 166/299 |
| 4,067,389 | 1/1978 | Savins | 166/246 |
| 4,109,721 | 8/1978 | Slusser | 166/280 |
| 4,548,252 | 10/1985 | Stowe et al. | 166/299 |
| 4,590,997 | 5/1986 | Stowe | 166/299 X |

*Primary Examiner*—Stephen J. Novosad
*Attorney, Agent, or Firm*—Alexander J. McKillop; Michael G. Gilman; Charles A. Malone

[57] ABSTRACT

A controlled pulse fracturing (CPF) process conducted with the addition of a proppant. Said proppant can comprise sand or similar material which is injected into the fluid adjacent to the perforations. Upon ignition of the CPF device, said proppant is injected into the created fractures, thereby propping said fractures open. This causes a production increase from the well. Said fluid can comprise water, a gel, a thixotropic fluid, or similar type fluids.

15 Claims, No Drawings

USE OF A PROPPANT WITH CONTROLLED PULSE FRACTURING

FIELD OF THE INVENTION

This invention is directed to a method for fracturing and propping radial fractures created during controlled pulse fracturing of hydrocarbonaceous formations or reservoirs.

BACKGROUND OF THE INVENTION

It has been known for some time that the yield of hydrocarbons, such as gas and petroleum, from wells can be increased by fracturing the formation so as to stimulate the flow of hydrocarbons in the well. Various formation fracturing procedures have been proposed and many now are in use. Among these procedures are treatments with various chemicals (usually acids in aqueous solutions), hydraulic fracturing in which liquids are injected under high pressure (usually with propping agents), explosive methods in which explosives are detonated within the formations to effect mechanical fracture, and combinations of the above procedures.

Chemical treatments usually involve the use of large volumes of chemicals which can be expensive and difficult to handle, and which pose problems of contamination and disposal. Hydraulic fracturing ordinarily requires that large volumes of liquids be made available at the well site and that equipment be made available for handling these large volumes of liquid. Again, there can be disposal problems, as well as contamination of the well. Explosive methods can be exceptionally hazardous from the standpoint of transporting and using the necessary explosives. These methods also present difficulties in controlling the effects of such a procedure.

Other suggestions for increasing the yield of existing wells entail heating the formation to induce the flow of hydrocarbons from the formation. Methods and apparatus have been developed by which various combustion devices have been lowered into the borehole of a well to attain heating of the formation adjacent the device. The effectiveness of such devices is limited by the necessity for fitting the devices into a borehole and then obtaining only more-or-less localized effects.

A combustion method designed to stimulate the well through mechanical fracture is known as controlled pulse fracturing or high energy gas fracturing. A good description of this method appears in an article by Cuderman, J. F., entitled "High Energy Gas Fracturing Development," Sandia National Laboratories, *SAND* 83-2137, October 1983. Using this method enables the multiple fracturing of a formation or reservoir in a radial manner which increases the possibility of contacting a natural fracture. Unfortunately, these radial fractures often do not penetrate deeply enough into the formation.

Slusser in U.S. Pat. No. 4,109,721 issued on Aug. 29, 1978 discusses a method of proppant placement during a hydraulic fracturing treatment. Via this method, a first proppant pack was deposited in the lower portion of a fracture. Afterwards, a slug of fracturing fluid liquid containing fluid loss additives was injected into the formation to deposit the fluid loss additives along the upper leading edge of the proppant pack. This provided a seal along the upper edge of the proppant pack. Thereafter, a high filter loss fracturing fluid, containing proppants, with no fluid loss additives was injected into the formation at a pressure to extend the fracture further.

During hydraulic fracturing when a proppant is utilized the fracturing fluid must be selected to allow the proppant to remain suspended until said fracturing treatment is completed which may require several hours. Because there is a time interval between the hydraulic fracturing treatment and the injection of the fluid containing the proppants, often sufficient proppant does not enter the desired fracture.

Therefore, what is needed is a method which will provide for proppant placement within fractures upon the initiation of said fractures thereby allowing for increased amounts of proppant placement within said fractures.

SUMMARY

This invention is directed to a method for treating fractures resultant from controlled pulse fracturing. In the practice of this invention, a high energy impulse device is placed into a well bore contained in a subterranean formation near said formation's productive interval. Afterwards, a proppant, of a size sufficient to prop said fractures, is injected into the wellbore. Said proppant is suspended in a liquid which covers said productive interval.

Thereafter, said high energy impulse device is ignited. Upon ignition said device generates fracturing pressure and maintains a peak pressure load sufficiently above the in-situ stress pressure but below the rock yield stress for a time sufficient to simultaneously create multiple radial fractures. Said pressure is also sufficient to cause proppant entry into said fractures thereby propping and extending said fractures.

Creating fractures by this method leads to the production of increased volumes of desired resources from said formation. This method is particularly applicable to formations containing hydrocarbonaceous fluids.

It is therefore an object of this invention to create and simultaneously prop multiple radial fractures, near the wellbore and extend those fractures into the formation.

It is yet another object of this invention to avoid damaging rock near the wellbore when creating multiple fractures and extending said fractures into the formation.

It is still another object of this invention to create simultaneous multiple fractures large enough to contain sufficient amounts of a proppant and generate pressure sufficient to extend more than two multiple fractures into a formation.

It is a further object of this invention to extend at least three simultaneous multiple fractures into the formation for a distance sufficient to contact at least one natural hydrocarbonaceous fluid producing fracture.

It is a still further object of this invention to obtain increased quantities of natural resources from underground formations, particularly formations containing hydrocarbonaceous fluids.

It is a yet further object of the present invention to increase the productivity of damaged wells by creating simultaneous multiple fractures in combination with a proppant suspended in a liquid.

DESCRIPTION OF THE PREFERRED EMBODIMENTS

In the preferred embodiment of this invention, it is desired to create simultaneous multiple radial fractures into a wellbore or borehole and extend said fractures without crushing the wellbore or borehole. It is desired to create multiple extended radial fractures to enhance the possibility for recovering natural resources, oil, or hydrocarbonaceous fluids. To accomplish this a high energy impulse device containing a propellant is suspended into a wellbore. This device is placed downhole next to the productive interval of a formation containing said resources, e.g. oil, or hydrocarbonaceous fluids.

The propellant in said device can belong to the modified nitrocellulose or the modified and unmodified nitroamine propellant class. Suitable solid propellants capable of being utilized include a double-based propellant known as N-5. It contains nitroglycerine and nitrocellulose. Another suitable propellant is a composite propellant which contains ammonium perchlorate in a rubberized binder. The composite propellant is known as HXP-100 and is purchasable from the Holex Corporation of Hollister, Calif. N-5 and HXP-100 propellants are disclosed in U.S. Pat. No. 4,039,030 issued to Godfrey et al. which patent is hereby incorporated by reference.

A N-5 solid propellant was utilized by C. F. Cuderman in an article entitled "High Energy Gas Fracturing Development," Sandia National Laboratories, *SAND* 83-2137, October 1983. This article is also incorporated by reference. High energy gas fracturing or controlled pulse fracturing is a method used for inducing radial fractures around a wellbore or borehole. Via this method a solid propellant-based means for fracturing is employed along with a propellant composed to permit the control of pressure loading sufficient to produce multiple fractures in a borehole at the oil or hydrocarbonaceous fluid productive interval. A peak pressure is generated which is substantially above the in-situ stress pressure but below the rock yield stress pressure.

After placing said device into said wellbore or borehole, a proppant of a size sufficient to prop resultant fractures is injected into the wellbore or borehole. Said proppant is suspended in a liquid carrier fluid prior to being injected into said wellbore or borehole. Proppants and methods for packing said proppants are discussed in U.S. Pat. No. 4,109,721 issued to Slusser on Aug. 29, 1978. This patent is hereby incorporated by reference.

Liquid carrier fluids which can be utilized herein are discussed in U.S. Pat. No. 3,642,068 issued to Fitch et al. on Feb. 15, 1972. This patent is hereby incorporated by reference. Some of these liquids include water, lease cruide oil, diesel oil, natural gums, gels, and thixotropic fluids for example. An aqueous solution which can be used as a carrier liquid is discussed in U.S. Pat. No. 4,067,389 issued to Savins on Jan. 10, 1978. This patent is hereby incorporated by reference.

Once the injection of the carrier fluid with proppant therein is in place at the desired productive interval, said device is ignited. Ignition of the propellant causes the generation of heat and gas preesure and provides the means for creating multiple fractures. As is known to those skilled in the art, the amount of heat and pressure produced is dependent upon the kind of propellant used, its grain size and geometry. Heat and pressure generation also depends upon the burning rate, weight of charge and the volume of gases generated. Subsequently, the heat and pressure are maintained for a time sufficient to allow fluid penetration and extension of fractures. As is known, heat generation and pressure maintenance are dependent upon the nature of the formation and the depth it is desired to extend the fractures into the formation. Simultaneous with the generation of pressure, proppant contained in the carrier fluid is caused to enter at least three vertical radial fractures thereby propping said fractures, and causing said fractures to be extended. When the pressure has dissipated said proppant props said fractures and prevents them from closing. Upon intersecting a fracture containing desired resources, particularly hydrocarbonaceous fluids, the propped fractures allow increased volumes of said resources to be produced from said formation.

One application of this method is for facilitating the removal of ores from a formation containing same. Sareen et al. in U.S. Pat. No. 3,896,879, disclose a method for increasing the permeability of a subterranean formation penetrated by at least one well which extends from the surface of the earth into the formation. This method comprises the injection of an aqueous hydrogen peroxide solution containing therein a stabilizing agent through said well into the subterranean formation. After injection, the solution diffuses into the fractures of the formation surrounding the well. The stabilizing agent reacts with metal values in the formation which allows the hydrogen peroxide to decompose. The composition of hydrogen peroxide generates a gaseous medium causing additional fracturing of the formation. Sareen et al. were utilizing a method for increasing the fracture size to obtain increased removal of copper ores from a formation. This patent is hereby incorporated by reference. Utilization of the present invention will increase a formation's permeability by creating additional fractures.

In addition to removing ores, particularly copper ores and iron ores from a formation, the present invention can be used to recover geothermal energy more efficiently by the creation of more fractures. A method for recovering geothermal energy is disclosed in U.S. Pat. No. 3,863,709 which issued to Fitch on Feb. 4, 1975. This patent is hereby incorporated by reference. Disclosed in this patent is a method and system for recovering geothermal energy from a subterranean geothermal formation having a preferred vertical fracture orientation. At least two deviated wells are provided which extend into the geothermal formation in a direction transversely of the preferred vertical fracture orientation. A plurality of vertical fractures are hydraulically formed to intersect the deviated wells. A fluid is thereafter injected via one well into the fractures to absorb heat from the geothermal formation and the heated fluid is recovered from the formation via another well.

The present invention can also be used to remove thermal energy produced during the situ combustion of coal by the creation of additional fractures. A method wherein thermal energy is produced by in situ combustion of coal is disclosed in U.S. Pat. No. 4,019,577 which issued to Fitch et al. on Apr. 26, 1977. This patent is hereby incorporated by reference. Disclosed therein is a method for recovering thermal energy from a coal formation which has a preferred vertical fracture orientation. An injection well and a production well are provided to extend into the coal formation and a vertical fracture is formed by hydraulic fracturing techniques. These fractures are propagated into the coal formation to communicate with both the wells. The vertical fracture is propped in the lower portion only. Thereafter, a combustion-supporting gas is injected into the propped portion of the fracture and the coal is ignited. Injection of the combustion-supporting gas is continued to propagate a combustion zone along the propped portion of the fracture and hot production gases generated at the combustion zone are produced to recover the heat or thermal energy of the coal. Water may also be injected into the fracture to transport the heat resulting from the combustion of the coal to the production well for recovery therefrom.

Recovery of thermal energy from subterranean formations can also be used to generate steam. A method for such recovery is disclosed in U.S. Pat. No. 4,015,663 which issued to Strubhar on Apr. 5, 1977. This patent is hereby incorporated by reference.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A method for treating fractures resultant from controlled pulse fracturing comprising:
   (a) placing a high energy impulse device containing a propellant into a wellbore contained in a subterranean formation near said formation's productive interval;
   (b) injecting into said wellbore a proppant, of a size sufficient to prop said fractures, suspended in a liquid which liquid covers said productive interval; and
   (c) igniting said propellant in said high energy impulse device which generates fracturing pressure and maintains a peak pressure load sufficiently above the in-situ stress pressure but below the rock yield stress for a time sufficient to create more than two simultaneous multiple radial fractures to allow fluid penetration, proppant entry into resultant fractures, and extension of said fractures.

2. The method as recited in claim 1 where in step (a) said high energy device comprises a modified nitrocellulose propellant.

3. The method as recited in claim 1 where in step (a) said high energy device comprises a modified nitroamine propellant.

4. The method as recited in claim 1 where in step (a) said high energy device comprises an unmodified propellant.

5. The method as recited in claim 1 where in step (a) said high energy device comprises a nitroglycerine and nitrocellulose double-based propellant.

6. The method as recited in claim 1 where in step a) said high energy device comprises an ammonium perchlorate composite propellant with a rubberized binder.

7. The method as recited in claim 1 where said proppant is suspended in a liquid which is a member selected from the group consisting of water, lease crude oil, diesel oil, natural gums, gels, and thixotropic fluids.

8. The method as recited in claim 1 where said formation contains a subterranean resource such as iron, copper ore, uranium ore, geothermal heat, coal, oil shale, or hydrocarbonaceous fluids.

9. A method for treating fractures resultant from controlled pulse fracturing of a hydrocarbonaceous bearing formation comprising:
   (a) placing a high energy impulse device containing a propellant into a wellbore contained in said formation near said formation's productive interval;
   (b) injecting into said wellbore a proppant of a size sufficient to prop said fractures, where said proppant is suspended in a liquid which covers said productive interval;
   (c) igniting said propellant in said high energy impulse device which generates fracturing pressure and maintains a peak pressure load sufficiently above the in-situ stress pressure but below the rock yield stress for a time sufficient to create more than two simultaneous radial fractures and simultaneously allow fluid penetration, propant entry into resultant fractures, and extension of said fractures; and
   (d) producing hydrocarbonaceous fluids from said formation.

10. The method as recited in claim 9 where in step (a) said high energy device comprises a modified nitrocellulose propellant.

11. The method as recited in claim 9 where in step (a) said high energy device comprises a modified nitroamine propellant.

12. The method as recited in claim 9 where in step (a) said high energy device comprises an unmodified propellant.

13. The method as recited in claim 8 where in step (a) said high energy device comprises a nitroglycerine and nitrocellulose double-based propellant.

14. The method as recited in claim 9 where in step (a) said high energy device comprises an ammonium perchlorate composite propellant with a rubberized binder.

15. The method as recited in claim 9 where said proppant is suspended in a liquid which is a member selected from the group consisting of water, lease crude oil, diesel oil, natural gums, gels, and thixotropic fluids.

* * * * *

UNITED STATES PATENT AND TRADEMARK OFFICE

CERTIFICATE OF CORRECTION

PATENT NO. : 4,714,114

DATED : December 22, 1987

INVENTOR(S) : Lloyd G. Jones

It is certified that error appears in the above-identified patent and that said Letters Patent is hereby corrected as shown below:

Column 3, line 57, "preesure" should be --pressure--.

Column 6, line 42 (claim 13), "Claim 8" should be --Claim 9--.

Signed and Sealed this

Thirty-first Day of May, 1988

*Attest:*

*Attesting Officer*

DONALD J. QUIGG

*Commissioner of Patents and Trademarks*